United States Patent [19]

Ballard

[11] Patent Number: 4,706,881

[45] Date of Patent: Nov. 17, 1987

[54] SELF-CORRECTING MICROPROCESSOR CONTROL SYSTEM AND METHOD FOR A FURNACE

[75] Inventor: Gary W. Ballard, Indianapolis, Ind.

[73] Assignee: Carrier Corporation, Syracuse, N.Y.

[21] Appl. No.: 802,272

[22] Filed: Nov. 26, 1985

[51] Int. Cl.[4] ..... F23N 1/00

[52] U.S. Cl. ..... 236/15 BD; 236/10; 236/156

[58] Field of Search ..... 236/15 BD, 15 C, 10, 236/11, 1 H, 1 A, 26 D, 26 B, 26 A, 94; 431/19, 20, 27

[56] References Cited

U.S. PATENT DOCUMENTS

| | | | |
|---|---|---|---|
| 1,455,860 | 5/1923 | Brown | 236/15 C |
| 1,919,743 | 7/1933 | Peters | 236/10 |
| 2,228,769 | 1/1941 | Klinker | 431/20 X |
| 3,454,078 | 7/1969 | Elwart | 236/10 X |
| 3,912,162 | 10/1975 | Bauer et al. | 236/11 |
| 4,334,855 | 6/1982 | Nelson | 236/15 C X |
| 4,373,662 | 2/1983 | Bassett et al. | 236/10 |

*Primary Examiner*—Harry Tanner
*Attorney, Agent, or Firm*—Dana F. Bigelow

[57] ABSTRACT

A self-correcting control system and method is provided for a furnace to correct certain operating conditions that exceed normal limits. Upon sensing insufficient air flow as a function of the pressure drop across the heat exchangers, the control system and method cause the inducer motor to increase in speed, thereby to increase the flow of combustion air. Similarly, upon sensing that the flow of air to be heated exceeds a predetermined temperature, the control system and method will increase the speed of the air blower to increase the flow rate of air to be heated through the furnace, thereby resulting in lowering the temperature of the air to be heated below the predetermined temperature. Upon sensing a gas flow leak through the gas regulator, the control system and method will recycle the gas regulator to properly seat a gas flow control valve therein. If none of the self-correcting features correct the particular occurring problem, the control system and method will shut down the furnace.

5 Claims, 4 Drawing Figures

SELF-CORRECTING MICROPROCESSOR CONTROL SYSTEM AND METHOD FOR A FURNACE

Background of the Invention

The present invention pertains to furnaces, and more particularly to a microprocessor control system and method that provides self-correcting features for a furnace.

In most furnaces, when certain operating limits are exceeded, the furnace will shut down requiring immediate maintenance prior to operating again to provide heat. For example, should the combustion air flow provide insufficient or too much combustion air, such that it exceeds a range of acceptable fuel air mixtures, the furnace will shut down. Causes for insufficient combustion air can be vent pipe restrictions, motor failure, or the condensate trap drain overflowing in a condensing furnace. Again, most of the current furnaces will shut down by terminating gas flow and require maintenance prior to operating once again.

Another operating parameter, which if exceeded can cause furnace shutdown, is insufficient flow of indoor air to be heated. Insufficient flow of indoor air will result in overheating the heat exchanger assembly, which will activate an over-temperature limit switch that will cause the furnace to shut down. In some furnaces, the furnace may reset itself after the heat exchanger assembly has cooled down, at which time the limit switch will reset. However, if the over-temperature condition continues to exist, the furnace will continually recycle on and off using the same air blower speed.

Causes for insufficient indoor air flow can be a dirty air filter, restrictions in the heating vents, and the like.

In present furnace designs, it is possible that the pilot solenoid gas seat will occasionally not seat properly due to dirt particles or other foreign matter generally from contaminated gas lines. Generally, gas leaks cannot be detected by most of the current gas regulators, thereby presenting an undesirable operating condition in the furnace.

SUMMARY OF THE INVENION

It is an object of the present invention to provide a control system for a furnace that attempts to self-correct for insufficient combustion air flow by increasing the speed of the inducer motor a selected number of times, after which, if the combustion air flow rate continues to be insufficient, the system will terminate gas flow.

Another object of the present invention is to provide a method of self-correcting a furnace experiencing insufficient combustion air flow.

Yet another object of the present invention is to provide a control system that will self-correct a furnace having insufficient flow of indoor air to be heated by increasing the speed of the air blower motor a selected number of times, after which, if the insufficient indoor air flow continues, the flow of gas to the furnace will be terminated.

A further object of the present invention is to provide a method for self-correcting a furnace experiencing insufficient flow of indoor air to be heated.

A still further object of the present invention is to provide a control system for a gas-fired furnace that will attempt to correct a gas valve leak by cycling the gas valve a selected number of times, after which, if the gas leak continues, the supply of gas to the valve will be terminated.

Yet a further object of the present invention is to provide a method for self-correcting a gas-fired furnace experiencing a gas valve leak.

In one form of the invention, there is provided a self-correcting microprocessor control system for a furnace and comprising a pressure-differential measuring device for measuring the pressure differential across the heat exchanger and for generating an air flow increase signal when the pressure differential falls below a predetermined value indicative of insufficient combustion air flow through a combustion chamber, and a microprocessor control for receiving the air flow increase signal and generating in response thereto a blower control signal to a blower means; the blower means providing in response to the received blower control signal an increase in flow of combustion air through the combustion chamber, thereby providing sufficient combustion air flow.

In another form of the present invention, there is provided a method of self-correcting the operation of a furnace, comprising the steps of measuring the pressure differential across a heat exchanger, determining when the measured pressure differential is less than a predetermined value indicative of insufficient combustion air flow through a combustion chamber, and increasing the combustion air flow to raise the measured pressure differential above the predetermined value, thereby indicating a sufficient flow of combustion air to the combustion chamber.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DETAILED DESCRIPTION

Figure 1:
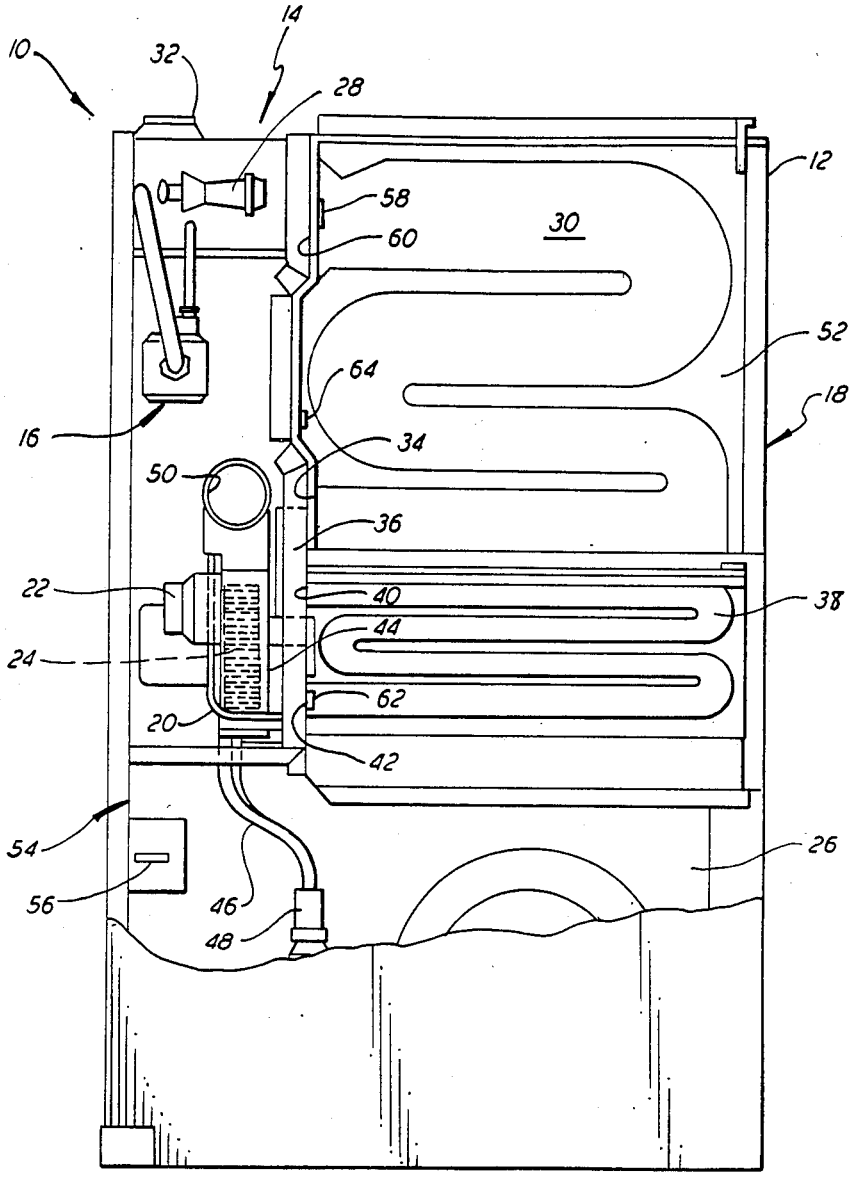
FIG. 1 is a partially broken-away side elevational view of a furnace incorporating the principles of the present invention.

Referring to FIG. 1, there is illustrated a gas-fired furnace which may be operated according to the principles of the present invention. The following description is made with reference to condensing furnace 10, but it should be understood that the present invention contemplates incorporation with a noncondensing-type furnace. Referring now to FIG. 1, condensing furnace 10 includes in major part steel cabinet 12 housing therein burner assembly 14, gas regulator 16, heat exchanger assembly 18, inducer housing 20 supporting inducer motor 22 and inducer wheel 24, and circulating air blower 26. Gas regulator 16 includes pilot circuitry for controlling and proving the pilot flame. This pilot circuitry or control can be a BDP model 740A pilot obtainable from BDP Company, Indianapolis, Ind.

Burner assembly 14 includes at least one inshot burner 28 for at least one primary heat exchanger 30. Burner 28 receives a flow of combustible gas from gas regulator 16 and injects the fuel gas into primary heat exchanger 30. A part of the injection process includes drawing air into heat exchanger assembly 18 so that the fuel gas and air mixture may be combusted therein. A flow of combustion air is delivered through combustion air inlet 32 to be mixed with the gas delivered to burner assembly 14.

Primary heat exchanger 30 includes an outlet 34 opening into chamber 36. Connected to chamber 36 and in fluid communication therewith is at least one condensing heat exchanger 38 having an inlet 40 and an outlet 42. Outlet 42 opens into chamber 44 for venting exhaust flue gases and condensate.

Inducer housing 20 is connected to chamber 44 and has mounted therewith inducer motor 22 with inducer wheel 24 for drawing the combusted fuel air mixture from burner assembly 14 through heat exchanger assembly 18. Air blower 26 delivers air to be heated upwardly through air passage 52 and over heat exchanger assembly 18, and the cool air passing over condensing heat exchanger 38 lowers the heat exchanger wall temperature below the dew point of the combusted fuel air mixture causing a portion of the water vapor in the combusted fuel air mixture to condense, thereby recovering a portion of the sensible and latent heat energy. The condensate formed within heat exchanger 38 flows through chamber 44 into drain tube 46 to condensate trap assembly 48. As air blower 26 continues to urge a flow of air to be heated upwardly through heat exchanger assembly 18, heat energy is transferred from the combusted fuel air mixture flowing through heat exchangers 30 and 38 to heat the air circulated by blower 26. Finally, the combusted fuel air mixture that flows through heat exchangers 30 and 38 exits through outlet 42 and is then delivered by inducer motor 22 through exhaust gas outlet 50 and thence to a vent pipe (not shown).

Cabinet 12 also houses microprocessor control assembly 54, LED display 56, pressure tap 58 at primary heat exchanger inlet 60, pressure tap 62 at condensing heat exchanger outlet 42 and limit switch 64 disposed in air passage 52; the purposes of which will be explained in greater detail below. If condensing furnace 10 is replaced with a noncondensing-type furnace, then naturally pressure tap 62 would be disposed at primary heat exchanger outlet 34, since there would be no condensing heat exchanger 38.

Figure 2:
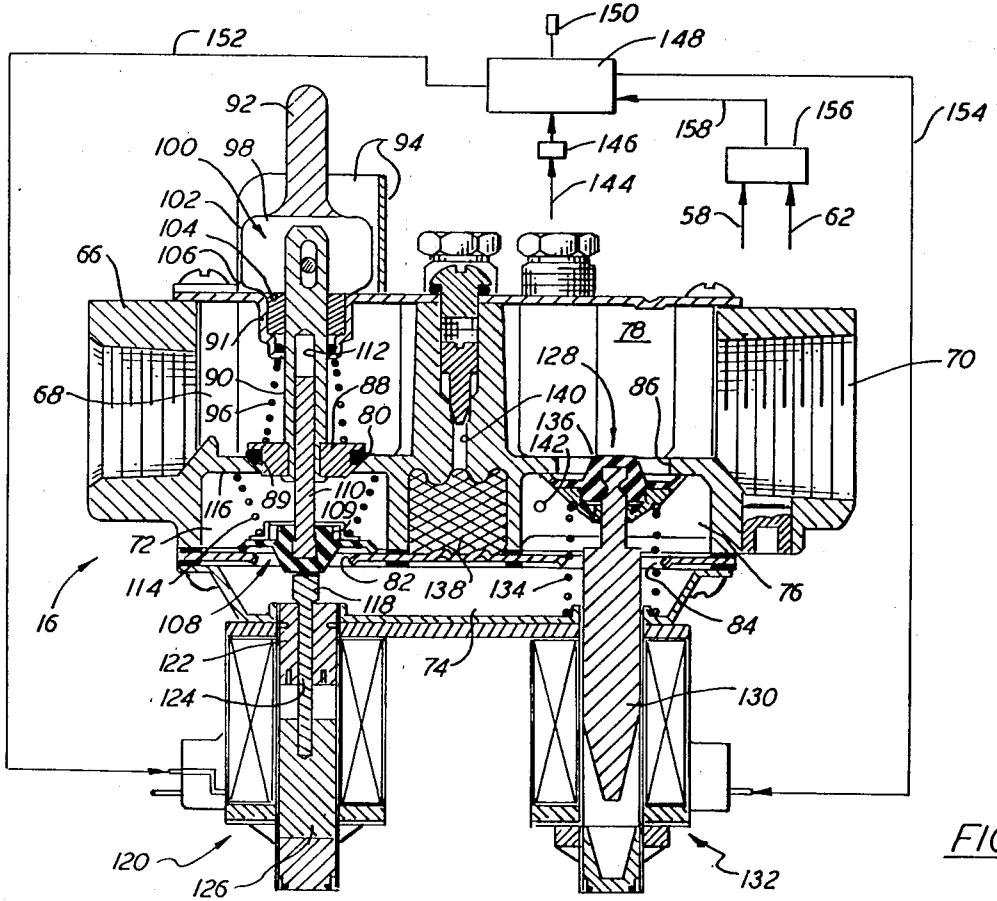
FIG. 2 includes a sectional view of a gas supply valve in conjunction with a schematic of a furnace control system incorporating the principles of the present invention.

Referring now to FIG. 2, gas regulator 16 generally comprises valve body 66 having an inlet 68 and outlet 70. Between inlet 68 and outlet 70 are a series of chambers, in particular, inlet chamber 72, intermediate chamber 74, regulator chamber 76, and main chamber 78. These chambers are in fluid communication, directly or indirectly, with valve body inlet 68 and outlet 70; inlet 68 communicates with inlet chamber 72 through inlet chamber seat 80, inlet chamber 72 communicates with intermediate chamber 74 through intermediate chamber seat 82, intermediate chamber 74 communicates with regulator chamber 76 through regulator seat 84, regulator chamber 76 communicates with main chamber 78 through main seat 86, and main chamber 78 communicates with outlet 70. The use of the term "seat" is equivalent to terms such as "opening", "hole", and the like.

Each of the above mentioned seats are closed and opened by particular members. Inlet chamber seat 80 is closed and opened by manually-operated valve head 88. Valve head 88 is connected to plunger 90, which is slidably received through valve body 66 in a fluid-tight manner. The externally remote end of plunger 90 is suitably connected to manual on-off valve 92, which is surrounded by indicator bracket 94. Bracket 94 is connected to valve body 66 in any suitable manner. Spring 96 is disposed within inlet 68 and between valve head 88 and the valve top cover plate 91 so as to bias valve head 88 into seating engagement with inlet chamber seat 80, thereby to prevent fluid communication between inlet 68 and inlet chamber 72. 0-ring 89 insures a fluid tight fit between valve head 88 and seat 80. To open or move valve head 88 to an open position to allow fluid communication between inlet 68 and inlet chamber 72, manual on-off valve 92 is rotated in a counter-clockwise direction, as viewed in FIG. 2. Manual on-off valve 92 includes an enlarged end portion 98 that has a camming surface 100. Camming surface 100 is defined by two relatively flat surfaces 102 and 104 that are generally perpendicularly disposed to each other and joined by a generally curved surface 106. As seen in FIG. 2, manual valve 92 is in the closed position so that spring 96 is biasing valve head 88 into seating engagement with inlet chamber seat 80 in a fluid-tight manner. As manual valve 92 is rotated counter-clockwise, the action of camming surface 100 and enlarged end portion 98 causes plunger 90 to be pulled upwardly against the force of spring 96 to separate valve head 88 from inlet chamber seat 80, thereby permitting fluid communication between inlet 68 and inlet chamber 72. Manual valve 92 is held in the open position by the engaging force or friction existing between flat surface 102 and the flat exterior surface portion of valve body 66. Naturally, to close inlet chamber seat 80, manual valve 92 is rotated clockwise to permit spring 96 to extend plunger 90 downwardly, thereby permitting valve head 88 to engage inlet chamber seat 80.

Intermediate chamber seat 82 is opened and closed by valve seat disc 108, which is disposed in inlet chamber 72. Valve seat disc 108 has a secondary plunger 110 connected thereto in any suitable manner and secondary plunger 110 is slidably received in bore 112, which is disposed in valve head 88 and plunger 90. Spring 114 is disposed in inlet chamber 72 between valve seat disc 108 and oppositely disposed inlet chamber upper surface 116. Spring 114 biases valve seat disc downwardly to close intermediate chamber seat 82 in a fluid tight manner. A rubber portion 109 insures a fluid tight fit between disc 108 and seat 82. Valve seat disc 108 is connected to secondary plunger 110 so that valve seat disc 108 moves in a generally vertical or straight line direction generally perpendicular to the plane of intermediate chamber seat 82, thereby insuring a fluid tight closure of intermediate chamber seat 82 when valve seat disc 108 is in the closed position, as illustrated in FIG. 2. Disposed on the opposite side of valve seat disc 108 and in general axial alignment with secondary plunger 110 is push rod 118. Push rod 118 abuts against the undersurface of valve seat disc 108, and upon being moved in an upwardly direction, push rod 118 moves valve seat disc 108 upwardly against spring 114 to open intermediate chamber seat 82, thereby permitting fluid communication between inlet chamber 72 and intermediate chamber 74. Push rod 118 is moved in an up and down direction, as viewed in FIG. 2, by pick and hold solenoid 120.

Solenoid 120 is connected to valve body 66 in any suitable manner and includes a joining segment 122 extending slightly inwardly of intermediate chamber 74. Joining segment 122 provides a fluid tight fit or connection between solenoid 120 and intermediate chamber 74. Joining segment 122 has an axial passage 124 for slidably receiving push rod 118 therein, with the lower remote end of push rod 118 being fixed loosely to movable plunger 126 of solenoid 120. When solenoid 120 is in a de-energized state, plunger 126 and push rod 118 are located in a lowermost position, as illustrated in FIG. 2, so that spring 114 biases valve seat disc 108 in fluid tight engagement with intermediate chamber seat 82. Upon energizing solenoid 120, plunger 126 and push rod 118 move upwardly against valve seat disc 108 and spring 114, thereby to open intermediate chamber seat 82 to allow fluid communication between inlet chamber 72 and intermediate chamber 74.

The fluid communication between intermediate chamber 74, regulator chamber 76, and main chamber 78 are closely related in that the opening and closing of regulator seat 84 and main seat 86 are controlled by a single regulator valve disc 128 disposed in regulator chamber 76. It should be noted that regulator seat 84 and main seat 86 are generally oppositely disposed from each other in regulator chamber 76 and are in generally axial alignment with each other, whereby the axial or linear movement of regulator valve disc 128 regulates the fluid communication between intermediate chamber 74, regulator chamber 76, and main chamber 78. Regulator valve disc 128 is connected in any suitable manner to regulator plunger 130 of regulator solenoid 132. A spring 134 is disposed against the underside of regulator valve disc 128 and through regulator seat 84, and biases regulator valve disc 128 upwardly to close main seat 86 in a fluid tight fashion. The upper portion 136 of regulator valve disc 128 is made of a rubber material to ensure fluid tight engagement between valve disc 128 and main seat 86. Regulator valve disc 128 is moved downwardly from its uppermost position where it closes main seat 86 to a lowermost position where it closes regulator seat 84, thereby opening main seat 86 to permit fluid communication between regulator chamber 76 and main chamber 78. Regulator valve disc 128 is moved to its lowermost position upon energizing regulator solenoid 132, which pulls regulator plunger 130 downwardly until valve disc 128 seats against regulator seat 84. By controlling the voltage to regulator solenoid 132, which will be explained in greater detail below, regulator valve disc 128 is positionable to an infinite number of positions between its uppermost position where it closes main seat 86 and its lowermost position where it closes regulator seat 84. Naturally, any position, other than the uppermost and lowermost positions, will provide simultaneous fluid communication between intermediate chamber 74, regulator chamber 76, and main chamber 78.

Figure 4:
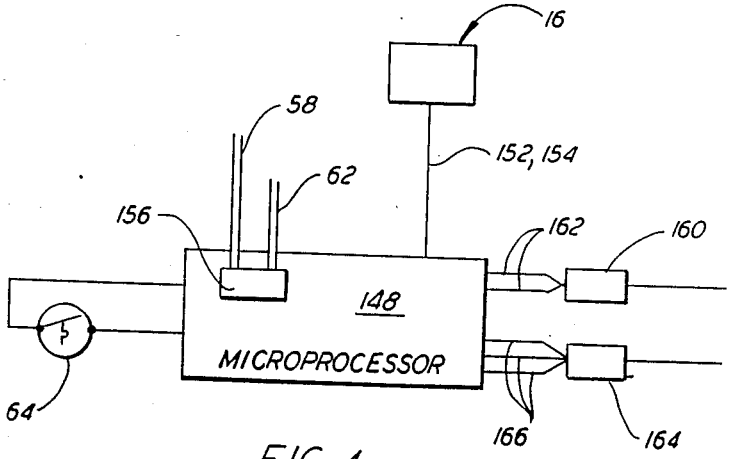
FIG. 4 is a block diagram of a portion of the furnace control system.

Disposed in fluid communication with intermediate chamber 74 are pilot filter 138 and pilot conduit 140 for respectively filtering the portion of the gas flowing through filter 138 and delivering it through pilot conduit 140 to the pilot flame assembly, which is part of gas regulator and pilot circuitry 16 (FIG. 4).

A pressure-tap port 142 is disposed in regulator chamber 76 for transmitting variations in fluid pressure from chamber 76 through line 144 to pressure transducer 146. Pressure transducer 146 then generates an analog signal to microprocessor control 148 indicative of a change in fluid pressure in regulator chamber 76. Microprocessor control 148 is located in microprocessor control assembly 54 in condensing furnace 10, and is capable of being preprogrammed to generate a plurality of control signals in response to received input signals. Microprocessor control 148 is also connected electrically to thermostat 150 to receive signals therefrom, to pick and hold solenoid 120 by electrical lines 152, and to regulator solenoid 132 by electrical lines 154.

Referring to FIG. 4, there is illustrated a simplified block diagram illustrating the interconnection between microprocessor control 148 and pressure taps 58, 62 through differential pressure transducer 156. As illustrated in FIG. 2, differential pressure transducer 156 receives pressure tap inputs from pressure taps 58, 62 and generates an analog signal indicative of the differential pressure to microprocessor control 148 via electrical lines 158.

Still referring to FIG. 4, it can be seen that microprocessor control 148 is electrically connected to limit switch 64 (FIG. 1), gas valve 16 through electrical lines 152, 154, and also to air blower motor control 160 of air blower 26 through electrical lines 162, and inducer motor control 164 of inducer motor 22 through electrical lines 166. Air blower motor control 160 and inducer motor control 164 respectively control the rate of fluid flow created by air blower 26 and inducer wheel 24.

With the manual on-off valve 92 moved in a counterclockwise position to open inlet chamber seat 80, and upon closing of contacts in thermostat 150 indicating a need for heat, microprocessor control 148 is programmed to send a signal via electrical lines 166 (FIG. 4) to inducer motor control 164 to start inducer motor 22 to rotate inducer wheel 24, thereby causing a flow of combustion air through combustion air inlet 32, burner assembly 14, heat exchanger assembly 18, inducer housing 20, and out exhaust gas outlet 50. After a predetermined period of time, for example, ten seconds, to ensure purging of the furnace, microprocessor control 148 generates a signal through electrical lines 152 to pick and hold solenoid 120, thereby energizing it to move plunger 126 upwardly so that push rod 118 separates valve seat disc 108 from intermediate chamber seat 82 to permit gas flow from inlet chamber 72 to intermediate chamber 74. The gas flows then to and through pilot filter 138 and pilot conduit 140 to initiate the pilot flame, and flows also into regulator chamber 76 where the pressure is sensed at pressure-tap port 142. Ignition of the pilot flame is proved by the pilot circuitry in the pilot control of gas regulator 16 and a signal is generated to microprocessor control 148 through electrical lines 152, 154 (FIG. 4) to indicate the flame is proved.

During this period of time, microprocessor control 148 (FIG. 2) is monitoring the pressure drop across heat exchanger assembly 18, which is provided by pressure taps 58, 62 transmitting pressure readings to differential pressure transducer 156. Differential pressure transducer 156 sends a pressure differential signal through electrical lines 158 to microprocessor control 148 indicative of the pressure drop reading. Pressure-tap port 142 is also transmitting increasing gas pressure in regulator chamber 76 through line 144 to pressure transducer 146, which generates an analog signal indicative of the increasing gas pressure to microprocessor control 148. After microprocessor control 148 determines a sufficient pressure drop exists across heat exchanger assembly 18, that the gas pressure in regulator chamber 76 is at or above a predetermined pressure, and the pilot flame has been proved, microprocessor control 148 is programmed to generate a voltage signal through electrical lines 154 to regulator solenoid 132. During this period of time, regulator valve disc 128 is closing off main seat 86 of main chamber 78 to prevent gas flow therethrough.

Because of the relatively high pressure existing in regulator chamber 76, the signal generated from microprocessor control 148 to regulator solenoid 132 is of a relatively high voltage to cause solenoid 132 to pull regulator plunger 130 to its lowermost position, whereby regulator valve disc 128 opens main seat 86 and closes regulator seat 84. This prevents fluid communication between regulator chamber 76 and intermediate chamber 74, but does permit fluid communication between regulator chamber 76 and main chamber 78. Thus, the increased gas pressure in regulator chamber 76 bleeds off through main seat 86, main chamber 78, and through outlet 70. This decreasing gas pressure in regulator chamber 76 is continually monitored by microprocessor control 148 through port 142 and upon reaching a predetermined low pressure, microprocessor control 148 generates a relatively low voltage signal to regulator solenoid 132 to open regulator seat 84 by moving regulator plunger 130 to an intermediate position between its uppermost position where it closes off main seat 86 and its lowermost position where it closes off regulator seat 84. Microprocessor control 148 is preprogrammed to position regulator valve disc 128 in regulator chamber 76 to provide a desired gas flow rate and pressure in main chamber 78.

Thereafter, gas flow is provided by gas regulator 16 to burner assembly 14 and the fuel air mixture is combusted by inshot burner 28. The combusted fuel air mixture is then drawn through heat exchanger assembly 18 and out exhaust gas outlet 50 by the rotation of inducer wheel 24 by motor 22. After a preselected period of time, for example, one minute, to ensure heat exchanger assembly 18 has reached a predetermined temperature, microprocessor control 148 is preprogrammed to generate a signal through electrical lines 162 (FIG. 4) to air blower motor control 160, which starts air blower 26 to provide a flow of air to be heated over condensing heat exchanger 38 and primary heat exchanger 30. Any condensate that forms in condensing heat exchanger 38 is delivered through drain tube 46 to condensate trap assembly 48.

After the heating load has been satisfied, the contacts of thermostat 150 open, and in response thereto microprocessor control 148 de-energizes pick and hold solenoid 120 and regulator solenoid 132. Plunger 126 then moves downwardly, as viewed in FIG. 2, under the influence of spring 114, and valve seat disc 108 closes intermediate chamber seat 82 due to the downwardly directed force provided by spring 114, thereby preventing fluid communication between inlet chamber 72 and intermediate chamber 74. In addition, upon de-energizing regulator solenoid 132, regulator plunger 130 moves upwardly under the influence of spring 134 and regulator valve disc 128 is moved to its uppermost position under the force exerted by spring 134 to thereby close off main seat 86. Thus, both intermediate chamber seat 82 and main seat 86 are closed to prevent gas flow through gas regulator 16. This naturally causes the pilot flame and burner flame to be extinguished, and upon cooling down of the pilot assembly, all switches are reset.

After regulator solenoid 132 is de-energized, microprocessor control 148 generates a signal over electrical lines 166 to inducer motor control 160 to terminate operation of inducer motor 22. After inducer motor 22 has been de-energized, microprocessor control 148 is further preprogrammed to generate a signal over lines 162 to air blower motor control 160, thereby terminating operation of air blower 26, after a preselected period of time, for example, 60–240 seconds. This continual running of air blower 26 for this predetermined amount of time permits further heat transfer between the air to be heated and the heat being generated through heat exchanger assembly 18, which also naturally serves to cool heat exchanger assembly 18.

Microprocessor control 148 also controls operation of the valve (not shown) that supplies a flow of gas to gas regulator 16.

Condensing furnace 10 is provided with self-correcting features that attempt to correct certain faults prior to totally shutting down the furnace for subsequent maintenance. Microprocessor control 148 has its control logic programmed to allow attempts at self-correction in three areas. The first is insufficient combustion air, the second is insufficient indoor air, and the third is a gas valve leak through gas regulator 16.

Figure 3:
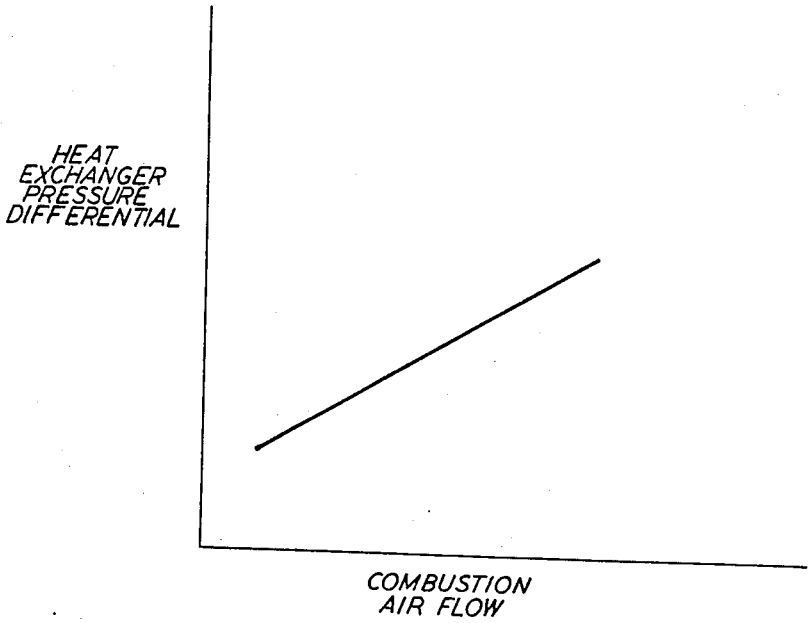
FIG. 3 is a plot of a curve indicating the relationship between heat exchanger pressure differential and optimum manifold gas pressure.

Determination of insufficient or too much combustion air flowing through combustion air inlet 32 is determined by the pressure drop across heat exchanger assembly 18. A pressure drop is measured by pressure taps 58, 62 and a signal is generated in response thereto by differential pressure transducer 156 to microprocessor control 148. Generally for each manifold gas pressure valve, there is an optimum combustion air flow rate with an associated differential pressure valve. The relationship between differential pressure and desired combustion air flow is shown in FIG. 3. Thus, assuming the manifold gas pressure is substantially constant, variations in certain parameters, as detected by the pressure drop across heat exchanger assembly 18, can require adJustment of the combustion air flow rate as provided by inducer wheel 24. Microprocessor control 148 provides a substantially constant gas flow rate t1:rough gas regulator 16 by adjusting the position of regulator valve disc 128 in response to pressure signals received from pressure-tap port 142 and pressure transducer 146. Regulator valve disc 128 is positioned by regulator solenoid 132 moving plunger 130 in response to received signals from microprocessor control 148.

Upon determining insufficient combustion air flow through burner assembly 14, as indicated by a low pressure drop across heat exchanger assembly 18, microprocessor control 148 generates a speed increase signal to inducer motor control 164 (FIG. 4) to select the next higher motor speed tap, thereby increasing the combustion air flow rate through burner assembly 18 and increasing the pressure drop across heat exchanger assembly 18. If this corrects the insufficient combustion air problem, furnace 10 will continue to operate and microprocessor control 148 will cause LED display 56 to indicate a code signifying a higher inducer motor speed is being provided. If, after selecting the next higher motor speed, microprocessor control 148 continues to determine insufficient combustion air flow, it will cause gas regulator 16 to terminate the supply of gas flow, thereby shutting down furnace 10.

In a similar manner, microprocessor control 148 can determine insufficient flow of air to be heated through furnace 10 by the activation of temperature limit switch 64 (FIGS. 1 and 4), which will open when the temperature in air passage 52 exceeds a predetermined temperature limit. Again, microprocessor control 148 is programmed to receive this signal indicating opening of limit switch 64 and in response thereto to generate a speed increase signal to air blower motor control 160. Air blower motor control 160 then selects the next higher motor speed tap for air blower 26 to increase the flow of air to be heated through air passage 52. If this next higher air blower speed causes switch 64 to close, indicating sufficient air flow, furnace 10 will continue to operate and microprocessor control 148 will cause LED display 56 to display a code indicating air blower 26 is operating at a higher speed. If microprocessor control 148 determines that the higher air blower speed is insufficient, indicated by limit switch 64 remaining open, control 148 will terminate gas flow through gas regulator 16 to shut down furnace 10.

During normal operation of furnace 10, there are periods when no heat is requ:ired and microprocessor control 148 has caused regulator solenoid 132 to close main seat 86 and pick and hold solenoid 120 to close intermediate chamber seat 82. If during this period of time when furnace 10 is providing no heat, a gas leak occurs through gas regulator 16, microprocessor control 148 will sense the leak and attempt to eliminate it. For example, should valve seat disc 108 not properly seat against intermediate chamber seat 82, gas will flow through seat 82, intermediate chamber 74, regulator seat 84, and into regulator chamber 76. The increasing pressure in regulator chamber 76 caused by the gas leak will be sensed through pressure-tap port 142 and a signal will be transmitted from pressure transducer 146 to microprocessor control 148 indicating undesired gas flow. Similarly, should a gas flow leak occur through both intermediate chamber seat 82 and main seat 86, a slightly lower increase in gas pressure occurs in regulator chamber 76 that will be sensed by microprocessor control 148. In either case, upon determining a gas leak occurs, microprocessor control 148 is programmed to cycle either pick and hold solenoid 120 by itself, or to cycle together both solenoids 120 and 132, in an attempt to properly seat valve seat disc 108, or to properly seat both valve seat disc 108 and regulator valve disc 128. If the gas leak is terminated, as sensed by a normal pressure reading in regulator chamber 76 by microprocessor control 148, furnace 10 will continue to operate and control 148 will cause LED display 56 to display a code indicating gas regulator 16 has been recycled. If the gas leak continues to occur after control 148 has cycled either solenoid 120 or both solenoids 120, 132, control 148 will cause LED display 56 to indicate a code informing the user that a gas leak occurs, will terminate gas flow to gas regulator 16, and will also override any input from thermostat 150. Also, if desired, an audio alarm can be provided to also indicate a continued gas leak.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a gas-fired furnace including a housing having a combustion air inlet and an exhaust gas outlet, a combustion means in said housing in communication with said combustion air inlet for receiving a flow of combustion air and for burning a mixture of combustion air and fuel, a fuel supply means in said housing and connected to said combustion means for supplying a flow of fuel to said combustion means, a heat exchanger means in said housing in communication with said combustion means and said exhaust gas outlet for delivering a flow of combusted fuel air mixture therethrough, and a blower means in said housing in communication with said combustion means and said heat exchanger means for providing a flow of combustion air through said combustion air inlet and said combustion means and a flow of a combusted fuel air mixture through said heat exchanger means and said exhaust gas outlet, a self-correcting microprocessor control system, comprising:

a pressure-differential measuring means for measuring a pressure differential across said heat exchanger means and for generating a pressure signal in response thereto indicative of the pressure differential value, a microprocessor control means for receiving said pressure signal, for determining when said pressure signal falls below a predetermined value indicative of insufficient combustion air flow through said combustion means, and for generating in response thereto a blower control signal to said blower means, said blower means providing in response to said received blower control signal an increase in flow of combustion air through said combustion means wherein if said microprocessor control means determines subsequent ones of said pressure signal to be less than said predetermined value, said microprocessor means generated in response thereto a termination signal to said fuel supply means, and said fuel supply means terminates in response to said received termination signal the flow of fuel to said combustion means.

2. In a gas-fired furnace including a housing having a combustion air inlet and an exhaust gas outlet, a combustion means in said housing in communication with said combustion air inlet for receiving a flow of combustion air and for burning a mixture of combustion air and fuel.

a fuel supply means in said housing and connected to said combustion means for supplying a flow of fuel to said combustion means, a heat exchanger means in said housing in communication with said combustion means and said exhaust gas outlet for delivering a flow of combusted fuel air mixture therethrough, and a blower means in said housing in communication with said combustion means and said heat exchanger means for providing a flow of combustion air through said combustion air inlet and said combustion means and a flow of a combusted fuel air mixture through said heat exchanger means and said exhaust gas outlet, a self-correcting microprocessor control system, comprising:

a pressure-differential measuring means for measuring a pressure differential across said heat exchanger means and for generating a pressure signal in response thereto indicative of the pressure differential value, a microprocessor control means for receiving said pressure signal, for determining when said pressure signal falls below a predetermined value indicative of insufficient combustion air flow through said combustion means, and for generating in response thereto a blower control signal to said blower means, said blower means providing in response to said received blower control signal an increase in flow of combustion air through said combustion means, an air delivery passage in said housing for delivering a flow of air to be heated over said heat exchanger means, a circulating air means in said housing for circulating a flow of air to be heated through said air delivery passage, a temperature-sensing means in said air delivery passage for sensing the temperature of the air to be heated as it flows over said heat exchanger means and for generating an air delivery increase signal when the temperature of the air to be heated exceeds a predetermined temperature, said microprocessor control means receiving said air delivery increase signal and generating in response thereto a circulating control signal to said circulating air means, said circulating air means providing in response to said received circulating control signal an increase in circulation of the air to be heated over said heat exchanger means, thereby to lower the temperture of the air to be heated below said predetermined temperature wherein said temperature-sensing means generates an insufficient circulating air flow signal when the temperature of the air to be heated remains above said predetermined temperature value after the increase in circulation thereof, said microprocessor control means receives said insufficient circulating air flow signal and generates in response thereto a termination signal to said fuel supply means, and said fuel supply means terminates in response to said received termination signal the flow of fuel to said combustion means.

3. In a gas-fired furnace including a housing having a combustion air inlet and an exhaust gas outlet, a combustion means in said housing in communication with said combustion air inlet for receiving a flow of combustion air and for burning a mixture of combustion air and fuel, a fuel supply means in said housing and connected to said combustion means for supplying a flow of fuel to said combustion means, a heat exchanger means in said housing in communication with said combustion means and said exhaust gas outlet for delivering a flow of combusted fuel air mixture therethrough, and a blower means in said housing in communication with said combustion means and said heat exchanger means for providing a flow of combustion air through said combustion air inlet and said combustion means and a flow of a combusted fuel air mixture through said heat exchanger means and said exhaust gas outlet, a self-correcting microprocessor control system, comprising:

a pressure-differential measuring means for measuring a pressure differential across said heat exchanger means and for generating a pressure signal in response thereto indicative of the pressure differential value, a microprocessor control means for receiving said pressure signal, for determining when said pressure signal falls below a predetermined value indictive of insufficient combustion air flow through said combustion means, and for generating in response thereto a blower control signal to said blower means, said blower means providing in response to said received blower control signal an increase in flow of combustion air through said combustion means wherein said fuel supply means includes a fuel flow valve means movable between a closed position and an open position for respectively terminating and initiating a flow of fuel therethrough, and further comprising a pressure detection means for detecting a flow of fuel through said fuel flow valve means when at said closed position and for generating a fuel flow signal in response thereto, wherein said microprocessor control means receives said fuel flow signal and generates in response thereto a valve cycle signal to said fuel supply means, wherein said fuel supply means cycles said fuel flow valve means to said open position and back to said closed position in response to receiving said fuel flow signal to prevent the continued flow of fuel through said valve means when at said closed position.

4. The furnace of claim 3 wherein if said microprocessor means receives subsequent ones of said fuel flow signal, said microprocessor means in response thereto terminates the flow to fuel to said fuel supply means.

5. A method of self-correcting the operation of a furnace, comprising the steps of:

measuring the presssure differential across a heat exchanger in the furnace, determining when the measured pressure differential is less than a predetermined value indicative of insufficient combustion air flow through a combustion chamber in the furnace, increasing the combustion air flow to raise the measured pressure differential above the predetermined value, thereby indicating a sufficient flow of combustion air to the combustion chamber; and terminating a flow of fuel to the combustion chamber when the increased combustion air flow continues to result in a measured pressure differential less than the predetermined value.

* * * * *